United States Patent [19]

Driessen

[11] Patent Number: 4,938,148

[45] Date of Patent: Jul. 3, 1990

[54] SEESAW SKI-TRACK

[76] Inventor: Ludovicus J. A. Driessen, Mosselerlaan 45, B-3600 Genk, Belgium

[21] Appl. No.: 301,108

[22] Filed: Jan. 25, 1989

[30] Foreign Application Priority Data

Jul. 25, 1988 [EP] European Pat. Off. ..... 88.201601.7

[51] Int. Cl.[5] ..... A63G 31/08

[52] U.S. Cl. ..... 104/58; 104/79

[58] Field of Search ..... 104/58, 79

[56] References Cited

U.S. PATENT DOCUMENTS

| | | | |
|---|---|---|---|
| 871,744 | 11/1907 | Van Kannel | 104/58 |
| 942,759 | 12/1909 | Taylor | 104/79 |
| 1,508,905 | 9/1924 | Vaszin | 104/58 |
| 1,965,676 | 7/1934 | Stock | 104/79 |
| 2,655,116 | 10/1953 | Gowland | 104/58 |

FOREIGN PATENT DOCUMENTS

| | | |
|---|---|---|
| 903891 | 4/1986 | Belgium . |
| 2516315 | 10/1976 | Fed. Rep. of Germany . |

*Primary Examiner*—Duane A. Reger

*Attorney, Agent, or Firm*—Watson, Cole, Grindle & Watson

[57] ABSTRACT

An adjustable seesaw ski-track includes a stationary central part and separate wing sections pivotally connected to opposite sides of the central part, each wing section including a horizontal platform section and a plurality of pivotally connected wing sections extending between the platform and the central part. A coupling rod connects the two wing sections together, and a hydraulic cylinder assembly is connected to one of the wing sections so as to raise and lower its platform section relative to the central part, thus pivoting the wing section upwardly and downwardly relative to the central part, the coupling rod causing the other wing section to respectively pivot downwardly and upwardly relative to the central part.

16 Claims, 5 Drawing Sheets

SEESAW SKI-TRACK

BACKGROUND AND SUMMARY OF THE INVENTION

The invention relates to a seesaw ski-track.

A seesaw ski-track is known from the Belgian Patent No. 903891. Here, getting onto the seesaw ski-track while it is in motion is difficult because skiers stepping on who are not yet well accustomed to the seesaw ski-track always have to take a step-up or a step-down constantly fluctuating in height, while other skiers are passing at that point with considerable speed.

The invention has for its object to facilitate stepping on and off. To this end the seesaw ski-track has a stationary central part and two wings pivotable relative to the central part on separately located axes. The central part hereby remains on one and the same level and can thus merge with an entrance at the same level.

BRIEF DESCRIPTION OF THE DRAWINGS

Mentioned and other features according to the invention will become apparent from the description following hereinafter with reference to a drawing, in which.

DETAILED DESCRIPTION OF THE DRAWINGS

Figure 5:
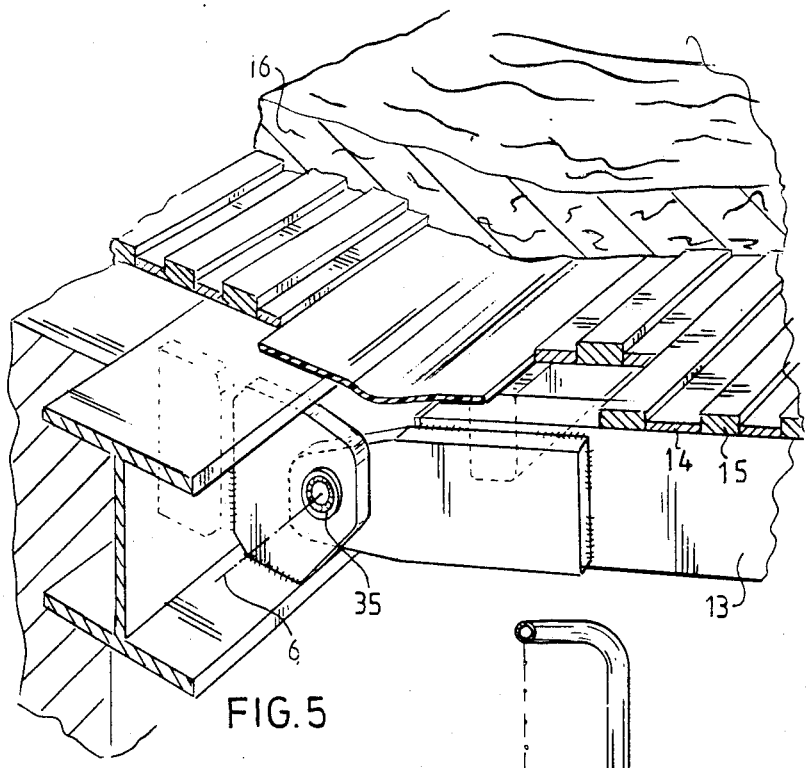
FIG. 5 shows on a larger scale a perspective view of detail V from FIG. 4.
Figure 6:
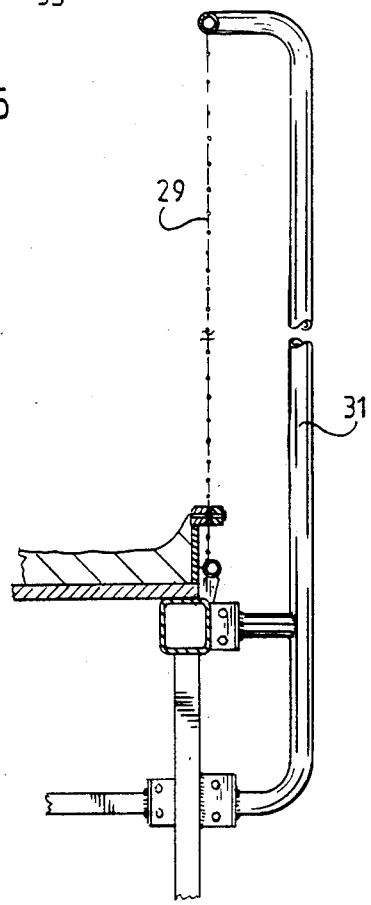
FIG. 6 shows a section along the line VI—VI from FIG. 4 on a larger scale.

Erected in a hall 1 for instance with a canteen 2 or stand with adjoining changing rooms on one side is a seesaw ski-track 3. The seesaw ski-track 3 has a fixed central part 4 and two wings 5 which can pivot relative to central part 4 on lying axes 6 which are arranged at a interval from each other a equal to the length of central part 4. Each wing 5 consists of three wing sections 8, 9 and 10 connected for pivoting with one another on axes 7, and a platform 11 which is pivotable on an axis 12 relative to wing section 10. Each wing section 8–10 and each platform 11 consists of a steel truss construction, upper longitudinal girders 13 of which bear alternately low and high cross slats 14 and 15, on which artificially formed snow 16 is held in position (FIG. 5). Lower longitudinal girders 17 of the wing sections 8, 9 and 10 are connected to one another by means of screwed rods 18 with left and right hand screw thread, with which the difference in slope between two adjoining wing sections 8, 9 and 10 is adjustable. In raised position of a wing 5 the slope of wing sections 8, 9 and 10 is steeper from the centre towards the outside. The platform 11 on the free wing end on the other hand always remains substantially horizontal. For this purpose platform 11 is linked to the fixed central part 4 with at least one hinged bar 19 hinged bar 19 which forms part of a parallelogram system having in the corners the axes 6 and 12 and the pivot shafts 20 of the hinged bar 19.

It is remarked that the hinged bar 19 is provided with length-adjusting means 21, for instance a screw socket coupling with left and right hand screw thread, so that when screwed rods 18 are adjusted the length of hinged bar 19 can be altered accordingly. Instead of a pressure loaded hinged bar 19 under the wing 5, a tensile strained bar or cable may also be arranged on each side of the wing 5 at a higher level than the ski surface.

Figure 1:
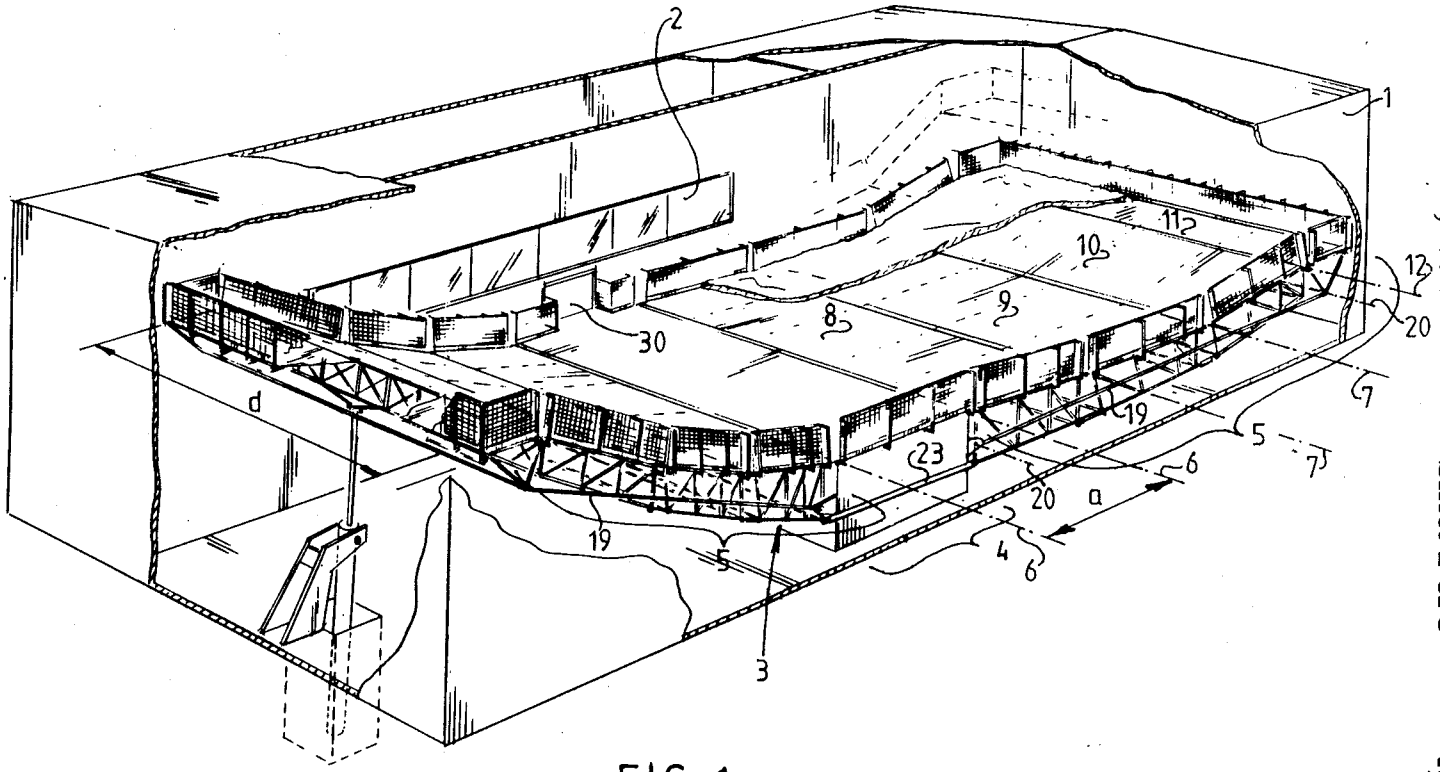
FIG. 1 is a cut away perspective view of a preferred embodiment of a seesaw ski-track according to the invention.
Figure 2:
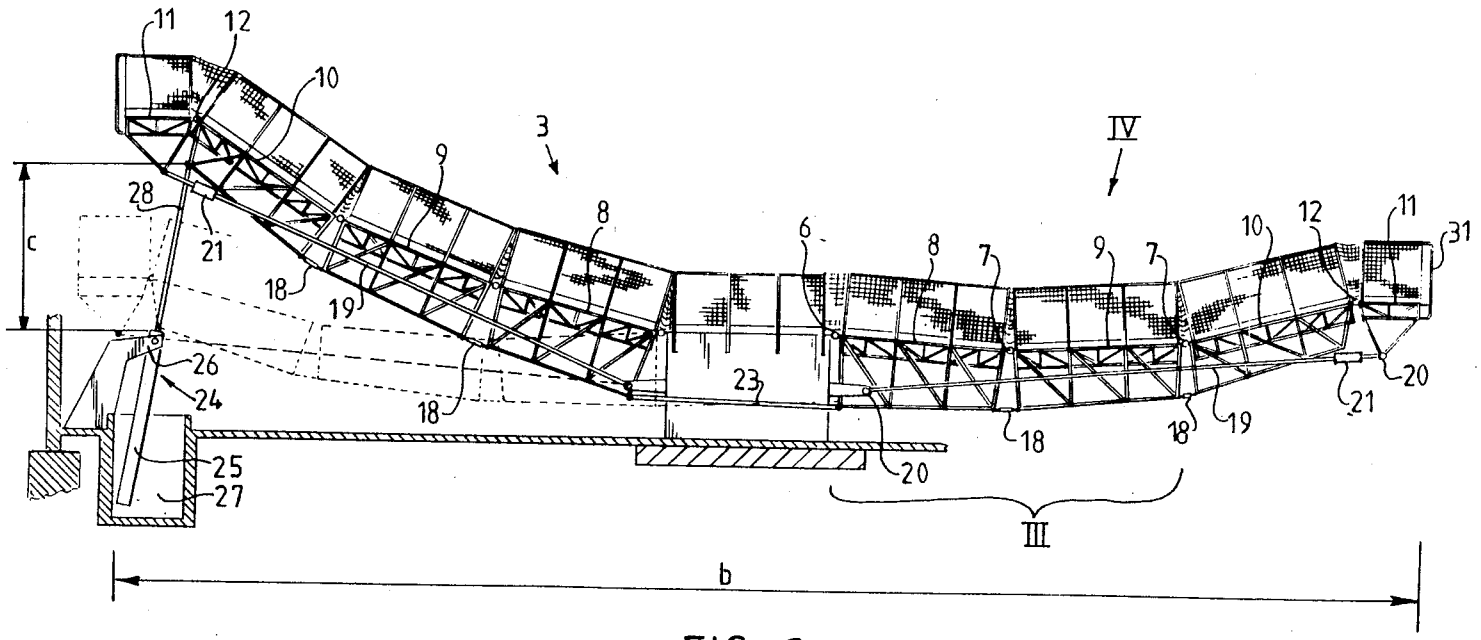
FIG. 2 is a side view, partly in section, of the seesaw ski-track of FIG. 1.
Figure 3:
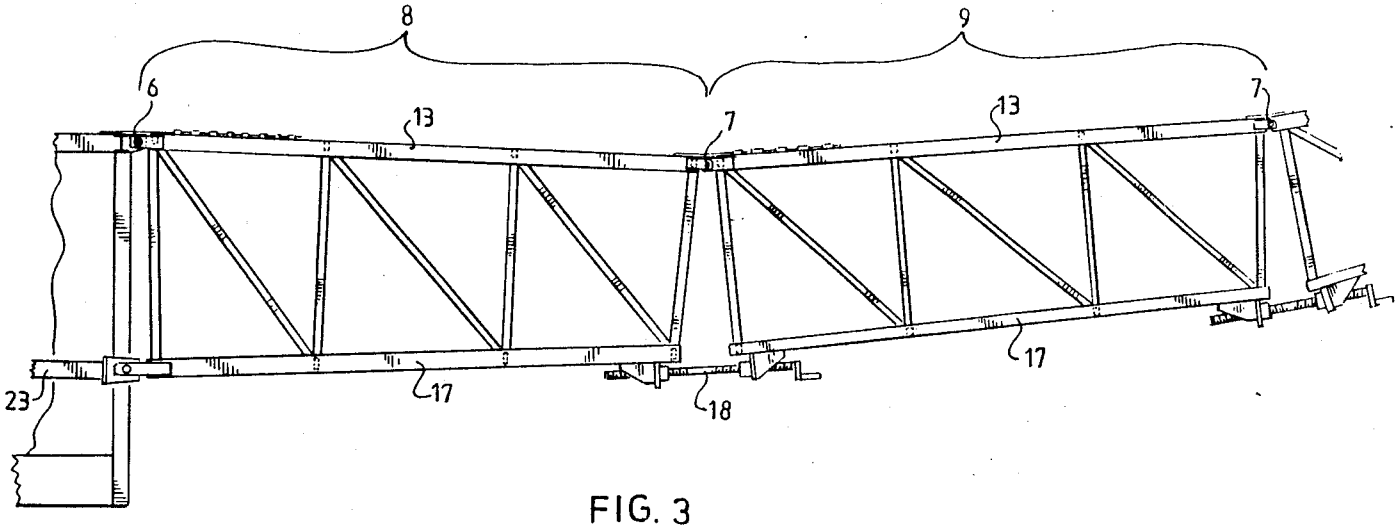
FIG. 3 shows on a larger scale detail III from FIG. 2.
Figure 4:
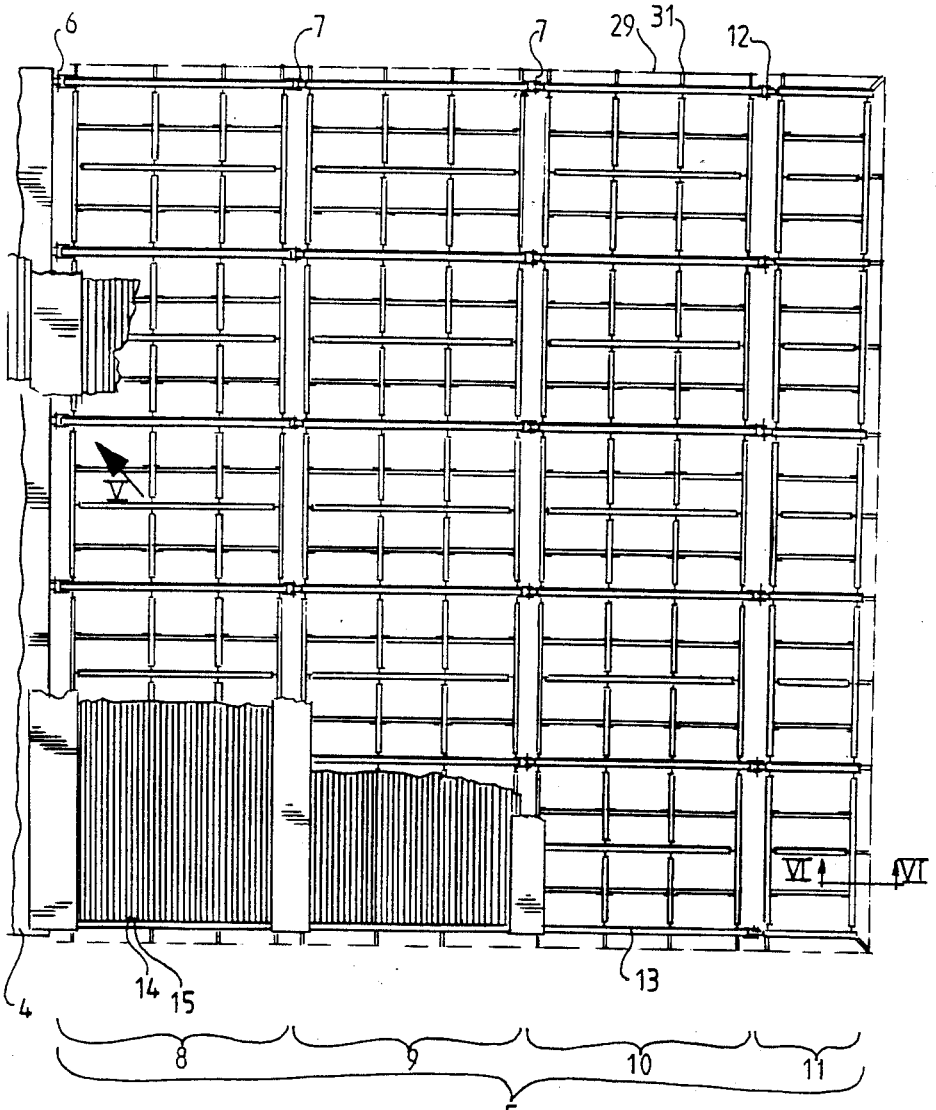
FIG. 4 is a top view of detail IV from FIG. 2.

Both wings 5 are coupled to each other by means of coupling rods 23 which engage for pivoting on lower longitudinal girders 17 of wing sections 8. Only one of the wings 5 is pivoted with a hydraulic cylinder assembly 24, whereof the cylinder 25 is suspended for pivoting at its piston rod end from a fixed bracket 26 above a pit 27, while the piston rod 28 thereof grips onto a wing 5. With actuation of cylinder 25 the driven wing 5 swings up and down between the positions indicated in FIG. 2 with full and dashed lines, thereby carrying the other wing 5 in cadence with it, such however that the other wing 5 moves upward when the one wing 5 moves downward and vice-versa. The reciprocating cycle can preferably be controlled, to last, for example, between 10 and 20 seconds in the case of a total length b of the swing in the order of magnitude of 50 m, and an up and downward lifting height c of an order of, for instance, 5 m. This lifting height can preferably be adjusted to a maximum for example of 6.5 m. It can also be arranged that the seesaw ski-track 3 moves intermittently with controllable, perhaps differing interval breaks and optionally at a different speed each time. The width d of the ski track is, for example, 25 m.

Arranged all around except at the entrance 30 is a safety net 29 that is attached to a bar fence 31 erected to the outside of safety net 29 and at a distance from it. Between wing sections 8, 9 and 10, platform 11 and central part 4 the safety net 29 is preferably elastic.

Stretched above the axes 6 and 12, that is, above the hinge joints 35 with which wings 5 are attached to the central part 4 and the platforms 11, is a strip of elastic material, for example, rubber. Above the axes 7 the joints between adjoining wing sections 8, 9 and 10 are filled up for instance with a strip of elastic material.

The dimensions mentioned and the forms of wing parts may be other than drawn. Thus, for example, the central part 5 can be considerably longer.

I claim:

1. A seesaw ski-track apparatus having a surface on which a skier can slide, said apparatus comprising:

a stationary central part which defines first and second pivot means at opposite first and second sides thereof, a first wing assembly which defines opposite first and second ends and which is pivotally connected at said second end thereof to said first pivot means, a second wing assembly which defines opposite first and second ends and which is pivotally connected at said second end thereof to said second pivot means, and drive means for raising and lowering said first end of said first wing assembly relative to said central part and cause said first wing assembly to pivot upwardly and downwardly around said first pivot means.

2. A seesaw ski-track apparatus according to claim 1, including first coupling means connecting said first and second wing assemblies so that the upward and downward pivoting of said first wing assembly around said first pivot means will cause respective downward and upward pivoting of said second wing assembly around said second pivot means.

3. A seesaw ski-track apparatus according to claim 1, wherein said first wing assembly, in a direction from said first end thereof to said second end, comprises a first platform section and at least one wing section pivotally connected to said first platform section.

4. A seesaw ski-track apparatus according to claim 3, wherein said first wing section includes first, second and third wing sections which are pivotally connected to each other, said third wing section being pivotally connected to said first pivot means.

5. A seesaw ski-track apparatus according to claim 4, including first adjustment means for adjusting a pivot angle between said first and second wing sections and between said second and third wing sections, respectively.

6. A seesaw ski-track apparatus according to claim 5, wherein said first adjustment means comprises screw sockets connected to the respective wing sections and screw rods extending therebetween.

7. A seesaw ski-track apparatus according to claim 6, wherein said second wing assembly, in a direction from said first end thereof to said second end, comprises a second platform section and at least one wing section pivotally connected to said second platform section.

8. A seesaw ski-track apparatus according to claim 7, wherein said second wing section includes fourth, fifth and sixth wing sections which are pivotally connected to each other, said sixth wing section being pivotally connected to said second pivot means.

9. A seesaw ski-track apparatus according to claim 8, including second adjustment means for adjusting a pivot angle between said fourth and fifth wing sections and between said fifth and sixth wing sections, respectively.

10. A seesaw ski-track apparatus according to claim 9, wherein said second adjustment means comprise screw sockets connected to the respective wing sections and screw rods extending therebetween.

11. A seesaw ski-track apparatus according to claim 10, including first coupling means connecting said third and sixth wing sections so that upward and downward pivoting of said third wing section about said first pivot means will cause respective downward and upward pivoting of said sixth wing section about said second pivot means.

12. A seesaw ski-track apparatus according to claim 11, wherein said first coupling means comprises a connecting rod.

13. A seesaw ski-track apparatus according to claim 11, including second coupling means respectively connecting said central part with said first and second platform sections to maintain said first and second platform sections in a horizontal orientation with the raising and lowering of said first and second wing assemblies.

14. A seesaw ski-track apparatus according to claim 13, wherein said second coupling means comprises hinged bars.

15. A seesaw ski-track apparatus according to claim 8, wherein each of said first, second, third, fourth, fifth and sixth wing sections provides an upper surface formed of parallel slats.

16. A seesaw ski-track apparatus according to claim 1, wherein said drive means comprises a hydraulic cylinder device.

* * * * *